US005449308A

United States Patent [19]

Thompson

[11] Patent Number: 5,449,308

[45] Date of Patent: Sep. 12, 1995

[54] MARKER BUOY WINDING APPARATUS AND IMPROVED MARKER BUOY USED THEREWITH

[76] Inventor: Gregory A. Thompson, 3031 SE. Eveningtide, Topeka, Kans. 66605

[21] Appl. No.: 215,312

[22] Filed: Mar. 21, 1994

[51] Int. Cl.[6] ..... B63B 22/00

[52] U.S. Cl. ..... 441/6; 242/390.8; 242/394; 242/400; 242/405.3; 441/23; 441/26

[58] Field of Search ..... 441/6, 23, 24; 242/390.8, 394, 400, 402, 405.3, 406, 596.3

[56] References Cited

U.S. PATENT DOCUMENTS

| | | | |
|---|---|---|---|
| 2,422,337 | 6/1947 | Chilowsky | 177/386 |
| 3,048,814 | 8/1962 | Francois | 340/4 |
| 3,653,085 | 4/1972 | Rovner | 9/8 |
| 3,693,886 | 2/1972 | Cotton | 242/390.8 |
| 3,910,524 | 10/1975 | Ireland | 242/390.8 |
| 4,657,517 | 4/1987 | Godwin | 441/1 |
| 4,721,486 | 1/1988 | Goettel | 441/6 |
| 4,778,422 | 10/1988 | Saulnier et al. | 441/26 |
| 4,781,636 | 11/1988 | Schurr | 441/6 |
| 4,808,133 | 2/1989 | Gram et al. | 441/6 |
| 5,066,256 | 11/1991 | Ward, Jr. | 441/7 |
| 5,087,216 | 2/1992 | Noggle | 441/26 |
| 5,195,688 | 3/1993 | Clemmons . | |
| 5,234,365 | 8/1993 | Cooper et al. | 441/11 |
| 5,376,035 | 12/1994 | Forrest | 441/26 |

*Primary Examiner*—Sherman Basinger
*Attorney, Agent, or Firm*—John R. Flanagan

[57] ABSTRACT

A pair of buoy winding apparatus includes a housing having a pair of opposite end portions and a central cavity defined therein between the opposite end portions and being open at a side thereof for receiving a marker buoy therein, a support shaft mounted to one opposite end portion of the housing and having an end protruding into one end of the central cavity, the end of the support shaft being adapted to rotatably engage one end of the marker buoy so as to rotatably support the one end of the marker buoy, and a drive motor mounted to the other of the opposite end portions of the housing and having an output drive shaft extending therefrom with an end protruding into an opposite end of the central cavity, the end of the output drive shaft being adapted to non-rotatably engage an opposite end of the marker buoy so as to rotatably drive the marker buoy, in response to actuation of operation of the drive motor, about a rotational axis defined by and between the support and drive shafts and extending between the opposite end portions of the housing. The marker buoy is improved by having a pair of detent elements disposed in respective enlarged opposite ends being adapted to respectively rotatably support and drivingly couple the marker buoy within the winding apparatus.

20 Claims, 4 Drawing Sheets

MARKER BUOY WINDING APPARATUS AND IMPROVED MARKER BUOY USED THEREWITH

BACKGROUND OF THE INVENTION

1. Field of the Invention

The present invention generally relates to winding devices and, more particularly, is concerned with a marker buoy winding apparatus and improved marker buoy used therewith.

2. Description of the Prior Art

Fishermen typically look for underwater structures, such as edges of submerged creek banks or drop offs, brush piles, old road beds, underwater bridges and the like, where fish are likely to congregate. When such structures are located, fishermen use marker buoys to temporarily mark their locations. After fishing the area, the fisherman will then remove the marker buoys. In a typical day of fishing, ten or more marker buoys may need to be dropped and retrieved.

The typical marker buoy used by fishermen has a body and a weight connected to the body by a flexible line which is wound about the body. Two configurations of marker buoys most commonly used by fishermen have a dumbbell-shaped body, such as illustrated in U.S. Pat. No. 3,653,085 to Rovner, and an H-shaped body, such as illustrated in U.S. Pat. No. 5,195,688 to Clemmons. Both of these marker buoy bodies have a pair of enlarged end portions connected by a central portion. The flexible tether line is connected at one end to and wound around the central portion of the body. When the body is placed on the surface of the water, the weight causes the body to rotate so as to unwind the tether line and allow the weight to sink in the body of water.

Rewinding the tether line onto the marker buoy body has been carried out heretofore both manually and mechanically. To manually rewind the tether line, the fisherman typically holds one of the enlarged ends of the body in one hand and winds the line about the central portion of the body using the other hand. This is time-consuming. In cold water conditions it is also extremely uncomfortable to reach into the water and reel up twenty to fifty feet or more of tether line by hand.

To mechanically rewind the line, the fisherman may use a separate winding device, such as disclosed in the above-cited Clemmons patent, or a rewinding device combined with the marker buoy, such as disclosed in U.S. Pat. No. 5,087,216 to Noggle and in U.S. Pat. No. 5,234,365 to Cooper et al. The separate winding device of the Clemmons patent employs a rotatable tubular member for containing one of the end portions and an electric motor for rotatably driving the tubular member and automatically winding the tether line back onto the central portion of the marker buoy body. The combined winding and marker buoy devices of the Noggle and Cooper et al patents respectively have manually and automatically operated reels mounted between buoyant side structures. The Clemmons, Noggle and Cooper devices represent steps in the right direction toward overcoming the drawbacks associated with directly manually gripping and rewinding the tether line.

However, it is perceived by the inventor herein that improvements are still needed in order to make the rewinding operation more efficient when using marker buoys having the aforementioned configurations.

SUMMARY OF THE INVENTION

The present invention provides a marker buoy winding apparatus and an improved marker buoy which are designed to satisfy the aforementioned need. The marker buoy winding apparatus is portable so that there is no need to install it at a fixed position on a boat. The marker buoy winding apparatus can be freely moved to any location about a boat so that only the apparatus and not the boat needs to be maneuvered to wind up the flexible tether line of a marker buoy.

Accordingly, the present invention is directed to a marker buoy winding apparatus which comprises: (a) a housing having a pair of opposite end portions and a central cavity defined therein between the opposite end portions and being open at a top thereof for receiving a marker buoy therein; (b) a support shaft mounted to one of the opposite end portions of the housing and having an end protruding into one end of the central cavity, the end of the support shaft being adapted to rotatably engage one end of the marker buoy so as to rotatably support the one end of the marker buoy; (c) a drive motor mounted to the other of the opposite end portions of the housing and having an output drive shaft extending therefrom with an end protruding into an opposite end of the central cavity, the end of the output drive shaft being adapted to non-rotatably engage an opposite end of the marker buoy so as to rotatably drive the marker buoy, in response to actuation of operation of the drive motor, about an axis defined by and between the support and drive shafts and extending between the opposite end portions of the housing; and (d) means for controlling operation of the drive motor so as to cause actuation and deactuation of operation of the drive motor.

The present invention is also directed to an improvement of the marker buoy used in the above-defined winding apparatus. The marker buoy has a body with a pair of enlarged opposite end portions and a reduced central portion extending between and rigidly interconnecting the enlarged opposite end portions. A flexible tether line is connected at one end to and wound around the reduced central portion of the body. When the body is placed on the surface of the water, a weight attached to the tether line causes the body to rotate so as to unwind the tether line and allow the weight to sink in the body of water.

The improved marker buoy has a pair of support and drive detent elements defined in the pair of enlarged opposite ends thereof. Both detent elements are disposed in alignment with one another along the marker buoy axis. The support detent element, functioning with the support shaft of the winding apparatus as part of a marker buoy support coupling, is in the form of a cylindrical receptacle being mounted, preferably by being inset, in the one enlarged end of the marker buoy and adapting the one enlarged end of the marker buoy to be rotatably supported by the support shaft of the marker buoy winding apparatus with its protruding end extending into the receptacle. The drive detent element, functioning with the output drive shaft of the drive motor, as part of a marker buoy drive coupling is in the form of a polygonal-shaped receptacle being mounted, preferably also by being inset, in the other of the enlarged ends of the marker buoy and adapting the other marker buoy end to be non-rotatably drivingly coupled with the complementarily-shaped end of the output drive shaft of the winding apparatus. The support shaft is yieldably mounted to the one end portion of the housing of the winding apparatus so as to be retractable away from the marker buoy to permit insert and removal of the respective receptacles of the support and drive detent elements onto and from the corresponding ends of the support and drive shafts. The yieldably mounted support shaft is also biased to extend toward the marker buoy to retain the respective ends of the support and drive shafts inserted in the respective receptacles of the support and drive detent elements so as to maintain the marker buoy in a supported relation in the central cavity of the winding apparatus.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
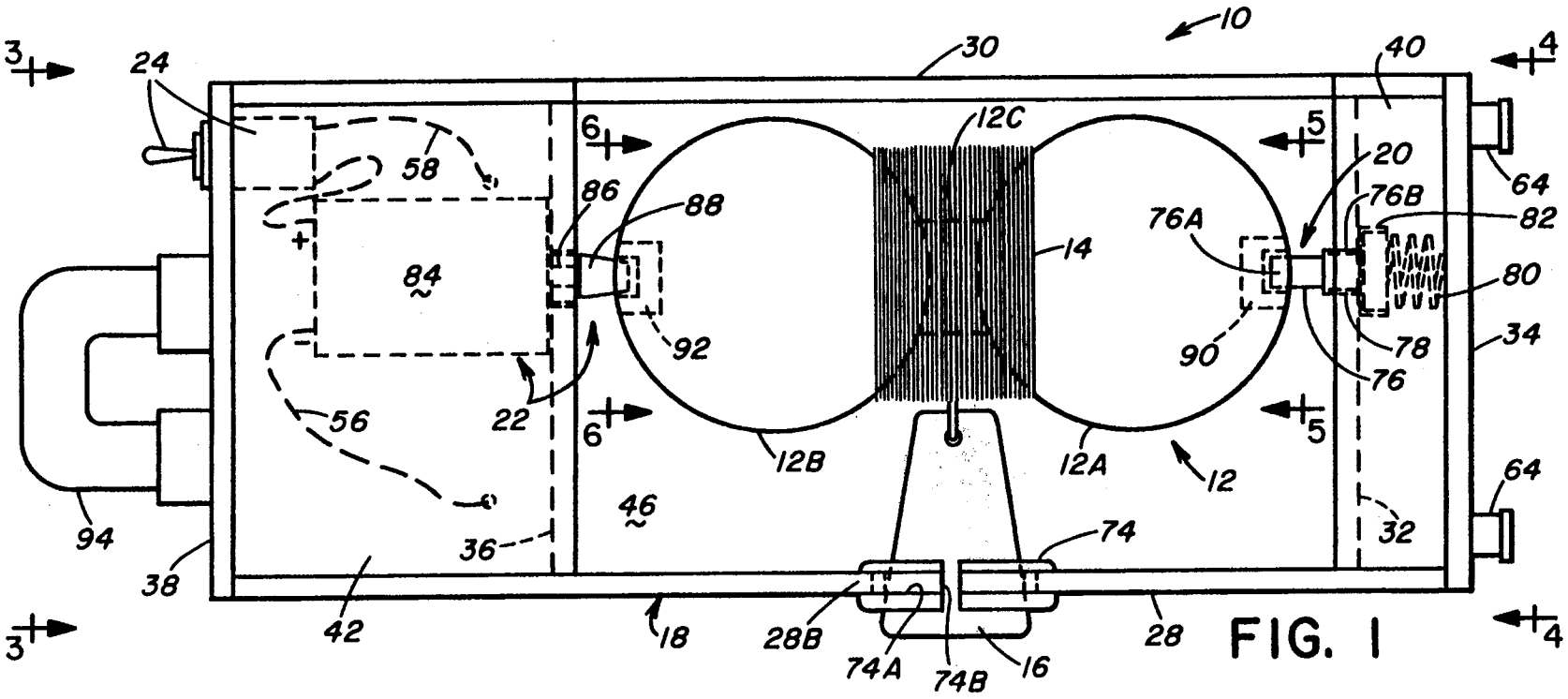
FIG. 1 is a top plan view of a marker buoy winding apparatus of the present invention and a dumbbell-shaped marker buoy improved in accordance with the present invention being mounted therein.
Figure 5:
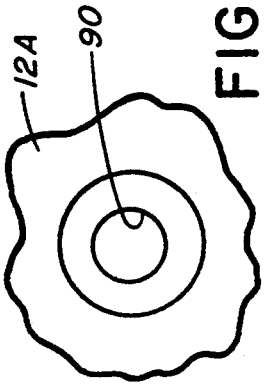
FIG. 5 is an enlarged fragmentary end view of one end of the improved dumbbell-shaped marker buoy, as seen along line 5—5 of FIG. 1, showing the support detent element defined in one enlarged end of the improved marker buoy.
Figure 6:
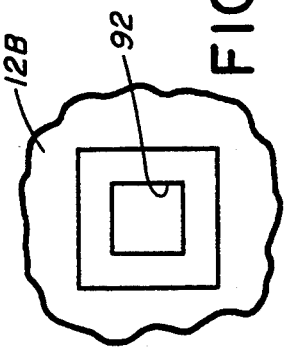
FIG. 6 is an enlarged fragmentary end view of an opposite end view of the improved dumbbell-shaped marker buoy, as seen along line 6—6 of FIG. 1, showing the drive detent element defined in the other enlarged end of the improved marker buoy.

Referring to the drawings, and particularly to FIGS. 1–4 and 7 there is illustrated a marker buoy winding apparatus, generally designated 10, of the present invention, being shown with a marker buoy 12 improved in accordance with the present invention mounted therein. In FIG. 1, the marker buoy 12 has a dumbbell-shaped configuration, whereas in FIG. 7 the marker buoy 12 has an H-shaped configuration.

Figure 7:
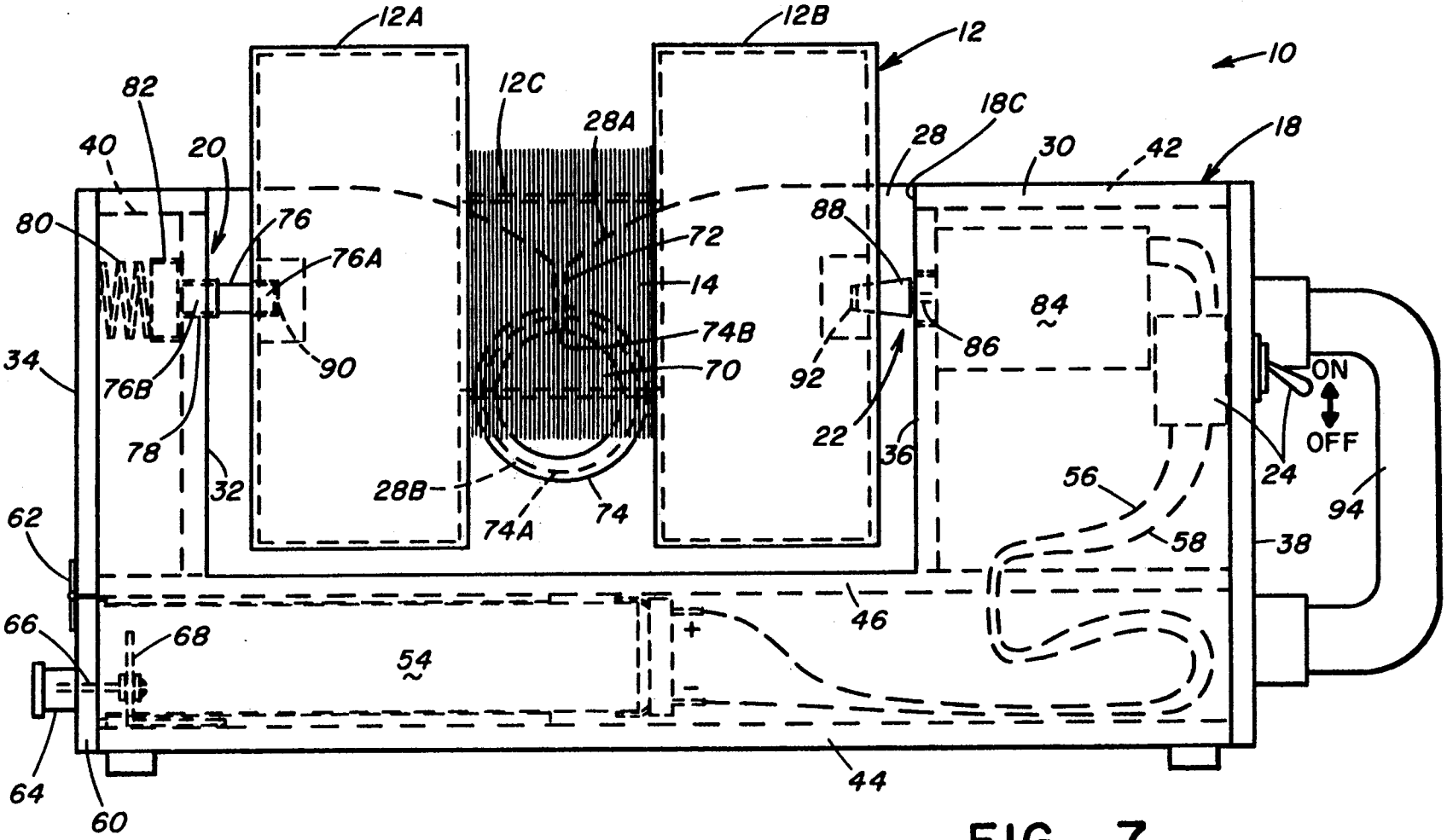
FIG. 7 is a rear elevational view of the winding apparatus of the present invention and an H-shaped marker buoy improved in accordance with the present invention being mounted therein.

As conventionally constructed with respect to both configurations of FIGS. 1 and 7, the marker buoy 12 has a body defined by a pair of enlarged opposite end portions 12A, 12B (being round-shaped in FIG. 1 and rectangular-shaped in FIG. 7) and a reduced central portion 12C (being cylindrical-shaped in FIG. 1 and square-shaped in FIG. 7) extending between and rigidly interconnecting the enlarged opposite end portions 12A, 12B. Also, as conventionally provided, a flexible tether line 14 is connected at one end to and wound around the reduced central portion 12C of the marker buoy 12.

When the marker buoy 12 is placed on the surface of a body of water, a weight 16 attached to an opposite end of the tether line 14 causes the marker buoy 12 to rotate so as to unwind the tether line 14 and allow the weight 16 to sink in the body of water. When it is desired to retrieve the marker buoy 12 and wind the tether line 14 about the reduced central portion 12C thereof, the marker buoy 12 is taken from the surface of the body of water and placed in the winding apparatus 10 of the present invention. The winding apparatus 10 is then operated to cause the marker buoy 12 to rotate about its own longitudinal axis and thereby cause the tether line 14 to wind up about the reduced central portion 12C thereof into the condition shown in FIG. 1.

Basically, the winding apparatus 10 of the present invention includes a housing 18, support means 20 and drive means 22 disposed in the housing 18 and defining a rotational axis A aligned with the longitudinal axis of the marker buoy 12 for respectively rotatably supporting and drivingly coupling with the enlarged opposite end portions 12A, 12B of the marker buoy 12, and switch means 24 for controlling operation of the drive means 22. The housing 18 has a pair of opposite end portions 18A, 18B and a central cavity 26 defined therebetween and being open at a side, such as centrally along the top 18C thereof, for receiving the marker buoy 12 therein. The support means 20 is mounted to one opposite end portion 18A of the housing 18 for rotatably supporting the one enlarged opposite end portion 12A of the marker buoy 12 when received in the central cavity 26. The drive means 22 is mounted to the other opposite end portion 18B of the housing 18 for drivingly engaging the other enlarged opposite end portion 12B of the marker buoy 12 when received in the central cavity 26. The drive means 22 is operable in response to manipulation of the switch means 24 to rotatably drive the marker buoy 12 about the rotational axis A in order to effect the aforementioned winding of the tether line 14 around the reduced central portion 12C of the marker buoy 12. The switch means 24, preferably an on/off momentary contact switch, is operable for controlling actuation and deactuation of operation of the drive means 22.

Referring still to FIGS. 1–4 and 7, the housing 14 includes a pair of opposite front and rear side walls 28, 30, pairs of inner and outer end walls 32, 34 and 36, 38 extending between and attached to the opposite front and rear side walls 28, 30, a pair of top walls 40, 42 extending between and attached to the opposite front and rear side walls 28, 30 and pairs of inner and outer end walls 32, 34 and 36, 38, a bottom wall 44 extending between and attached to the opposite front and rear side walls 28, 30, and a false floor 46 spaced above the bottom wall 44 and extending between and attached to the opposite front and rear side walls 28, 30 and the pairs of inner and outer end walls 32, 34 and 36, 38. The front and rear side walls 28, 30, pairs of inner and outer end walls 32, 34 and 36, 38, top walls 40, 42, bottom wall 44 and false wall 46 together form the opposite end portions 18A, 18B of the housing 18 having respective weatherproof end compartments 48, 50 defined therein and the central cavity 26 defined therebetween. The open top 18C of the housing 18 is defined between the spaced top walls 40, 42 above the central cavity 26.

Also, the bottom wall 44 and false floor 46 together with the pair of outer end walls 34, 38 and the pair of opposite front and rear side walls 38, 40 define a bottom compartment 52 therebetween. The winding apparatus 10 preferably also includes a removable electrical power supply 54, such as a d.c. battery pack, disposed within the bottom compartment 52 and connected by electrical conductor leads 56, 58 via the on/off momentary contact switch 24, to the drive means 22 being disposed within the right end compartment 50. The housing 18 includes a pivotal door 60 disposed in the one outer end wall 34 and attached thereto by a hinge 62. The pivotal door 60 is adapted to be moved from a closed open and close to provide access to the bottom compartment 52 in order to remove and replace the power supply 54 from and to the bottom compartment 52. In order to secure the door 60 in the closed position, knobs 64 are provided threaded onto screws 66 extending through apertures in the door 60 and supported on brackets 68 mounted on the bottom wall 44 within the bottom compartment 52. By unthreading and removing the knobs 64 from the screws 66, the door 60 can be swung open to remove and replace the battery 54.

Figure 2:
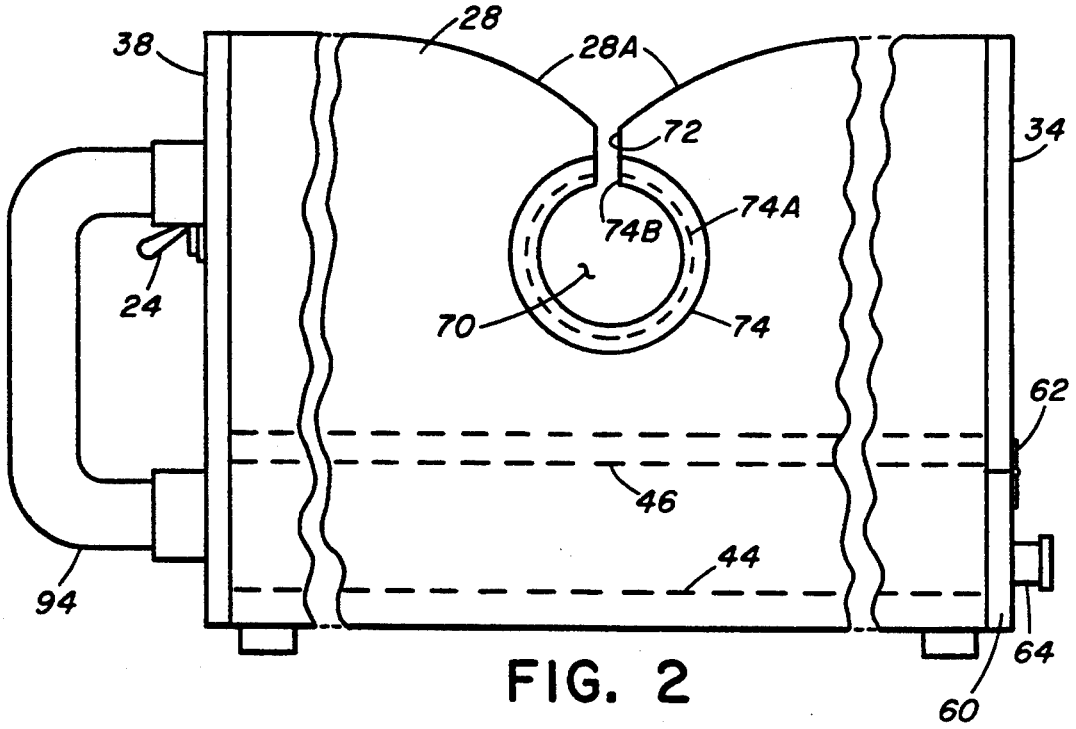
FIG. 2 is a front elevational foreshortened view of the winding apparatus of FIG. 1.

Referring to FIGS. 1, 2 and 7, the front side wall 28 of the housing 18 has a circular opening 70 defined therein spaced a short distance below the open top 18C of the housing 18, communicating with the central cavity 26 therein and aligned with the reduced central portion 12C of the marker buoy 12 received in the central cavity 26. A top edge portion 28A of the front side wall 28 is sloped or angled downwardly toward the opening 70, and a slot 72 is defined in the front side wall 28 extending from the downwardly sloped or angled top edge portion 28A thereof to the opening 70 therein such that the tether line 14 can be easily guided and inserted into and withdrawn from the opening 70 through the slot 72 to correspondingly place the tether line 14 through and remove it from the opening 70 in the front side wall 28.

A catch means 74 is mounted to the front side wall 28 about the opening 70 therein for engaging, cushioning and gripping the weight 16 attached on the tether line 14 when the tether line 14 becomes fully wound about the reduced central portion 12C of the marker buoy 12 in the central cavity 26 of the housing 18. The catch means 74 preferably takes the form of an annular-shaped rubber grommet 74 having an outwardly opened groove 74A defined about the periphery of the grommet 74, adapting the grommet 74 to fit about an annular rim portion 28B of the front side wall 28 defining the opening 70 so as to securely mount the grommet 74 about the opening 70. The grommet 74 also has a radial slot 74B therethrough defining a gap in the grommet 74 which aligns with the slot 72 in the front side wall 28 of the housing 18 so as to not obstruct the placement of the tether line 14 through and removal of the tether line 14 from the opening 70 in the front side wall 28 through the slot 72.

Referring to FIGS. 1 and 5–7, the support means 20 is disposed in the one end compartment 48 of the one opposite end portion 18A of the housing 18 between the pair of inner and outer walls 32, 34 thereof, whereas the drive means 22 is disposed in the other end compartment 50 of the other opposite end portion 18B between the pair of inner and outer walls 36, 38 thereof. The support means 20 includes a support shaft 76 having a cylindrical-shaped configuration and being slidably movable through a sleeve 78 mounted in the inner wall 32 of the housing 18 and having an inner end 76A protruding beyond the inner wall 32 into the central cavity 26 and being adapted to engage and rotatably support the one enlarged end portion 12A of the marker buoy 12. The support means 20 also includes biasing spring means in the form of a coiled spring 80 and cup-shaped spring retainer 82. The spring retainer 82 is attached on an outer end 76B of the support shaft 76 and limits its movement toward the marker buoy 12. The coiled spring 80 is disposed between the outer wall 34 and the spring retainer 82.

The drive means 22 preferably includes a d.c. electric drive motor 84 (and any necessary speed reduction gearing) mounted in the other end compartment 58 of the housing 18 between the inner and outer walls 36, 38 thereof. The drive motor 84 has a rotary output drive shaft 86 extending therefrom and protruding through the inner wall 36 into the central cavity 26. The inner end of the drive shaft 86 is provided with a drive element 88 having a polygonal-shaped configuration, such as square, and being adapted to engage and non-rotatably drivingly couple with the other enlarged end portion 12B of the marker buoy 12 so as to rotatably drive the marker buoy 12 about the rotational axis A extending through the support and drive shafts 76, 86 and between the opposite end portions 18A, 18B of the housing 18 in order to effect winding of the tether line 14 around the marker buoy 12, in response to actuation of operation of the drive motor 84. The yieldable nature of the biasing spring 80 permits support shaft 76 to move and yieldably retract away from the marker buoy 12 upon a user manually forceably shifting the marker buoy 12 toward the support shaft 76. Such retraction of the support shaft 76 permits installation and removal of the marker buoy 12 onto and from the support and drive shafts 76, 86. The resilient nature of the biasing spring 80 forces the support shaft 76 to move and extend through the sleeve 78 and toward the marker buoy 12 so as to retain the respective ends of the support and drive shafts 76, 86 engaged with the enlarged opposite end portions 12A, 12B of the marker buoy 12 and maintain the marker buoy 12 in a supported relation in the central cavity 26 of the winding apparatus 10.

Referring to FIGS. 1 and 5–7, there is illustrated the improvements made to the above-described conventional marker buoy 12, of both the dumbbell-shaped and H-shaped configurations, used with the above-described winding apparatus 10. The improved marker buoy 12 has a pair of support and drive detent elements 90, 92 defined in the pair of enlarged opposite end portions 12A, 12B thereof. Both detent elements 90, 92 are disposed in alignment with one another along the longitudinal or rotational axis A of the marker buoy 12. The support detent element 90, functioning with the inner end 76A of the support shaft 76 of the winding apparatus 10 as part of a marker buoy support coupling, is preferably in the form of a cylindrical receptacle 90 being mounted, preferably by being inset, into the one enlarged end portion 12A of the marker buoy 12, adapting the one enlarged end portion 12A of the marker buoy 12 to be rotatably supported by the support shaft 76 of the winding apparatus 10 with its protruding cylindrical end 76A extending into the cylindrical receptacle 90. The drive detent element 92, functioning with the output drive shaft 86 of the drive motor 84, as part of a marker buoy drive coupling, is preferably in the form of a polygonal-shaped receptacle 92 being mounted, preferably also by being inset, into the other enlarged end portions 12B of the marker buoy 12, adapting the other enlarged end portion 12B of the marker buoy 12 to be non-rotatably drivingly coupled with the similarly-shaped drive end 88 of the output drive shaft 86 of the winding apparatus 10. Thus, the detent elements 90, 92 adapt the marker buoy 12 to be respectively rotatably supported and drivingly coupled with the winding apparatus 10 so that by manipulating the the on/off momentary contact switch 24 mounted on the outer end wall 38, the marker buoy 12 driven from one end is rotated about its rotational axis A to wind up the tether line 14 and raise the weight 16 thereon. A handle 94 is attached at an angle on the outer wall 38 is employed to aim the grommet 74 in a downward direction to catch the weight 16 therein.

Figure 8:
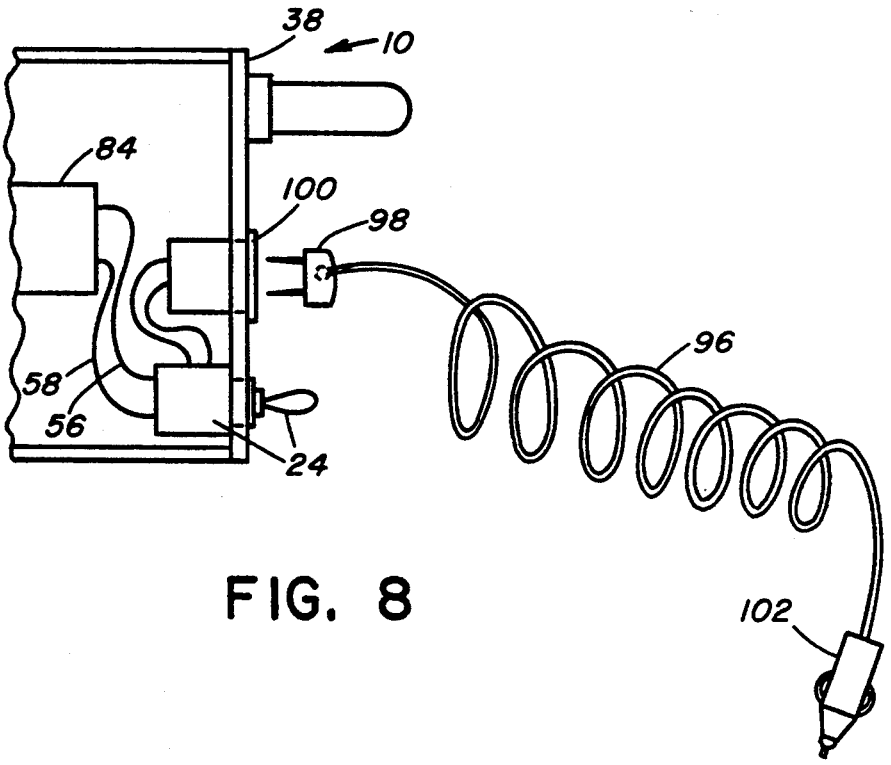
FIG. 8 is a fragmentary view of an end portion of the winding apparatus being modified to use an electical cord for plugging the winding apparatus into an external separate power source.
Figure 4:
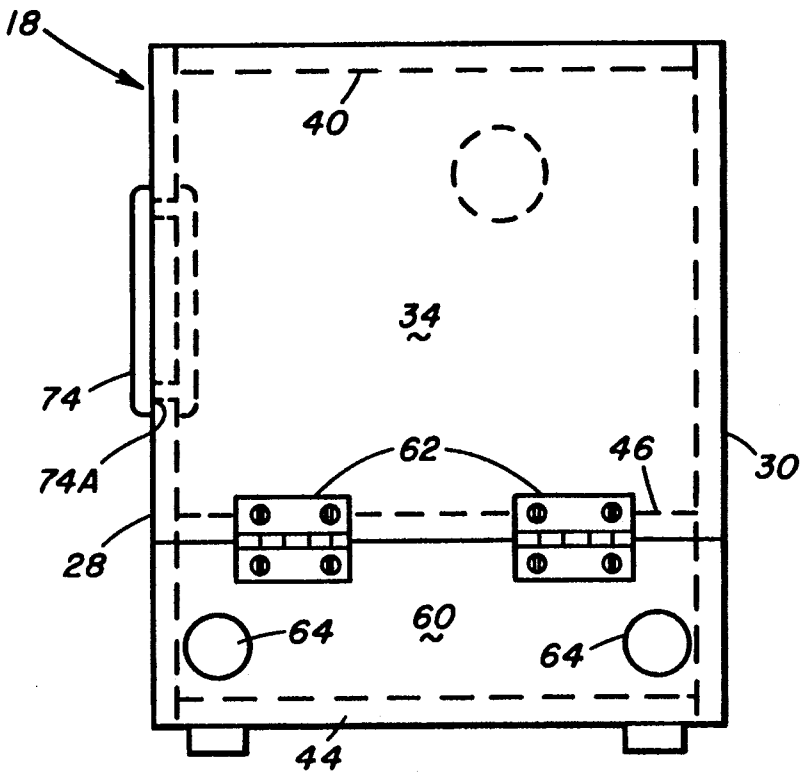
FIG. 4 is an opposite end elevational view of the winding apparatus as seen along line 4—4 of FIG. 1.
Figure 3:
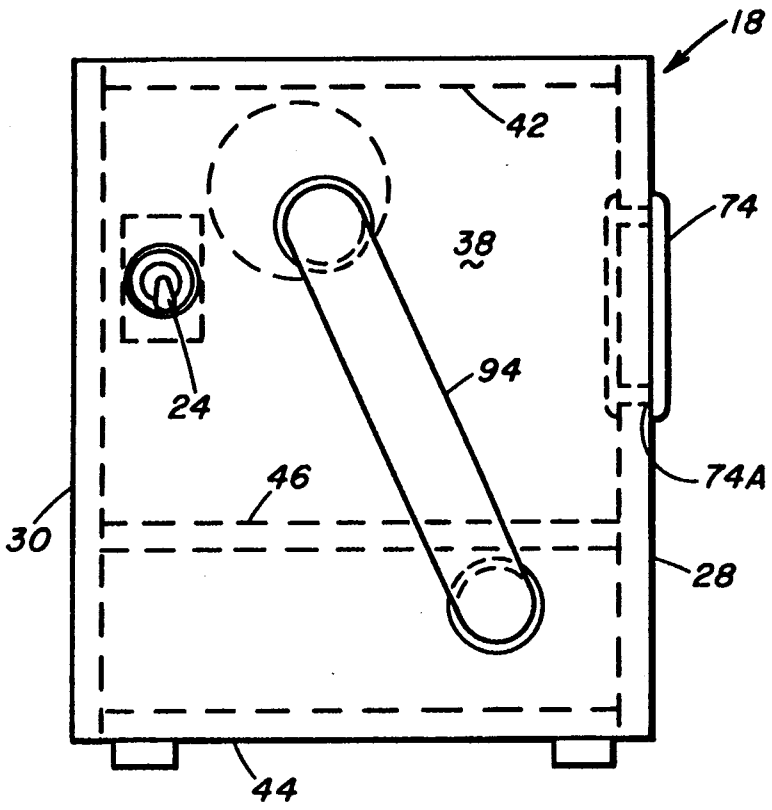
FIG. 3 is an end elevational view of the winding apparatus as seen along line 3—3 of FIG. 1.

Referring to FIG. 8, there is illustrated an end portion of the winding apparatus 10 modified to use an electical cord 96 having a male plug 98 on one end of the cord 96 for plugging into a female receptacle 100 on the winding apparatus 10 and a male plug-in device 102 on the other end of the cord 96 for plugging into a cigarette lighter or other type of power socket of an external power source as opposed to the battery power supply 54 contained in the winding apparatus 10, as shown in FIGS. 1 and 7. The power cord 96 would be stored in the bottom compartment 52 when not in use.

As an alternative, the drive means 22 can be a hand crank instead of an electric motor in order to provide a low cost, manually-powered unit.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A marker buoy winding apparatus, comprising:

(a) a housing having a pair of opposite end portions and a central cavity defined between said opposite end portions and being open at a side thereof for receiving a marker buoy therein;

(b) support means mounted to one of said opposite end portions of said housing for rotatably supporting one end of the marker buoy when the marker buoy is received in said cavity; and (c) drive means mounted to the other of said opposite end portions of said housing for drivingly engaging an opposite end of the marker buoy when the marker buoy is received in said cavity and being operable to rotatably drive the marker buoy about a rotational axis extending between said opposite end portions of said housing in order to effect winding of a flexible tether line being attached to the marker buoy around the marker buoy, in response to actuation of operation of said drive means;

(d) said support means including a support shaft mounted to said one opposite end portion of said housing and having an end protruding into said central cavity and being adapted to engage and rotatably support the one end of the marker buoy when the marker buoy is received in said cavity;

(e) said drive means including (i) a drive motor mounted to the other of said opposite end portions of said housing and having an output drive shaft extending therefrom with an end protruding into said central cavity and being adapted to non-rotatably engage an opposite end of the marker buoy when the marker buoy is received in said cavity so as to rotatably drive the marker buoy about said rotational axis defined by said support and drive shafts and extending between said opposite end portions of said housing in order to effect winding of the tether line around the marker buoy, in response to actuation of operation of said drive motor, and (ii) switch means connected to said drive motor and being operable for controlling actuation and deactuation of operation of said drive motor.

2. A marker buoy winding apparatus, comprising:

(a) a housing having a pair of opposite end portions and a central cavity defined between said opposite end portions and being open at a side thereof for receiving a marker buoy therein;

(b) support means mounted to one of said opposite end portions of said housing for rotatably supporting one end of the marker buoy when the marker buoy is received in said cavity;

(c) drive means mounted to the other of said opposite end portions of said housing for drivingly engaging an opposite end of the marker buoy when the marker buoy is received in said cavity and being operable to rotatably drive the marker buoy about a rotational axis extending between said opposite end portions of said housing in order to effect winding of a flexible tether line being attached to the marker buoy around the marker buoy, in response to actuation of operation of said drive means; and (d) a biasing spring means mounted to said one end portion of said housing and being coupled to said support means so as to permit said support means to move and yieldably retract away from the marker buoy when the marker buoy is received in said cavity to permit installation and removal of the one end of the marker buoy onto and from said support means, said biasing spring means also adapted to force said support means to move and extend toward the marker buoy when the marker buoy is received in said cavity to retain said respective ends of the support and drive means engaged with opposite ends of the marker buoy and maintain the marker buoy in a supported relation in said cavity of said housing.

3. A marker buoy winding apparatus, comprising:

(a) a housing having a pair of opposite end portions and a central cavity defined between said opposite end portions and being open at a side thereof for receiving a marker buoy therein;

(b) support means mounted to one of said opposite end portions of said housing for rotatably supporting one end of the marker buoy when the marker buoy is received in said cavity; and (c) drive means mounted to the other of said opposite end portions of said housing for drivingly engaging an opposite end of the marker buoy when the marker buoy is received in said cavity and being operable to rotatably drive the marker buoy about a rotational axis extending between said opposite end portions of said housing in order to effect winding of a flexible tether line being attached to the marker buoy around the marker buoy, in response to actuation of operation of said drive means; and (d) said housing including a pair of opposite side walls, one of said side walls having an opening defined therein communicating with said cavity and aligned with a central portion of the marker buoy when the marker buoy is received in said cavity and a slot defined therein extending from said opening to said open side of said cavity such that the tether line can be inserted into and withdrawn from said opening through said slot to correspondingly place the tether line through and remove the tether line from said opening in said one side wall.

4. The apparatus of claim 3 further comprising:

catch means mounted to said one side wall of said housing and extending about said opening therein for engaging and gripping a weight attached on the tether line when the tether line has become fully wound about the marker buoy when the marker buoy is received in said cavity of said housing.

5. The apparatus of claim 4 wherein said catch means is an annular-shaped rubber grommet having an outwardly opened peripheral groove adapted to fit about an annular rim portion Of said one side wall defining said opening so as to mount said grommet about said opening, said grommet having a radial slot therethrough defining a gap in said grommet aligned with said slot in said one side wall of said housing so as to not obstruct the placement of the tether line through and removal of the tether line from said opening in said one side wall through said slot.

6. The apparatus of claim 3 wherein said housing also includes a pair of inner and outer end walls extending between and attached to said pair of opposite side walls so as to define said pair of opposite end portions of said housing, each of said pairs of inner and outer end walls defining an end compartment in a respective one of said opposite end portions of said housing, said support means being disposed in said end compartment of said one opposite end portion of said housing and said drive means being disposed in said end compartment of said other opposite end portion of said housing.

7. The apparatus of claim 6 wherein said support means includes a support shaft mounted between one of said pair of inner and outer walls of said housing and having an end protruding through said inner wall of said one pair thereof into said central cavity and being adapted to engage and rotatably support the one end of the marker buoy.

8. The apparatus of claim 7 wherein said drive means includes a drive motor mounted between the other of said pair of inner and outer walls of said housing and having an output drive shaft extending therefrom with an end protruding through said inner wall of said other pair thereof and into said central cavity and being adapted to non-rotatably engage an opposite end of the marker buoy when the marker buoy is received in said cavity so as to rotatably drive the marker buoy about an axis defined by said support and drive shafts and extending between said opposite end portions of said housing in order to effect winding of the tether line around the marker buoy, in response to actuation of operation of said drive motor.

9. The apparatus of claim 8 wherein said support means also includes a biasing spring means mounted between said one pair of inner and outer walls of said housing and being coupled to said support shaft so as to permit said support shaft to move and yieldably retract away from the marker buoy to permit installation and removal of the one end of the marker buoy onto and from said support shaft, said biasing spring means also adapted to force said support shaft to move and extend toward the marker buoy to retain said respective ends of the support and drive shafts engaged with opposite ends of the marker buoy and maintain the marker buoy in a supported relation in said cavity of said housing.

10. The apparatus of claim 6 wherein said housing also includes a pair of top walls extending between and attached to said pair of opposite side walls and said pairs of inner and outer end walls so as to further define said pair of opposite end portions of said housing, each of said top walls overlying one of said respective end compartments.

11. The apparatus of claim 6 wherein said housing also includes a bottom wall extending between and attached to said pair of opposite side walls and said pair of outer end walls so as to further define said pair of opposite end portions of said housing.

12. The apparatus of claim 11 wherein said housing also includes a false floor spaced above said bottom wall and extending between and attached to said pair of opposite side walls and said pairs of inner and outer end walls so as to further define said pair of opposite end portions of said housing, said false floor underlying each of said respective end compartments.

13. The apparatus of claim 12 wherein said bottom wall and false floor together with said pair of outer end walls and said pair of opposite side walls define a bottom compartment therebetween.

14. The apparatus of claim 13 further comprising:

a power supply for said drive means being disposed within said bottom compartment; and a door defined in one of said pair of outer end walls being adapted to open and close to remove and replace said power supply from and to said bottom compartment.

15. A marker buoy winding system, comprising:

(a) a marker buoy including (i) a body having a pair of enlarged opposite end portions and a reduced central portion extending between and rigidly interconnecting said enlarged opposite end portions and defining a central axis of said body, and (ii) a pair of detent elements disposed in said respective enlarged opposite ends thereof, said detent elements being disposed in alignment with one another along said central axis of said body and adapted to respectively rotatably support and drivingly couple said body within a marker buoy winding apparatus; and (b) a marker buoy winding apparatus, said apparatus including (i) a housing having a pair of opposite end portions and a central cavity defined between said opposite end portions and being open at a side thereof for receiving said marker buoy therein, (ii) a support shaft mounted to one of said opposite end portions of said housing and having an end protruding into said central cavity and being adapted to rotatably engage and support said detent element in one of said enlarged end portions of said body of said marker buoy, (iii) a drive motor mounted to the other of said opposite end portions of said housing and having an output drive shaft extending therefrom with an end protruding into said central cavity and being adapted to non-rotatably engage said detent element in the other of said enlarged end portions of said body of said marker buoy so as to rotatably drive said marker buoy about an axis defined by said support and drive shafts and extending between said opposite end portions of said housing in order to effect winding of a flexible tether line around said marker buoy, in response to actuation of operation of said drive motor, and (iv) a switch electrically connected to said drive motor and being operable to control actuation and deactuation of operation of said drive motor.

16. The system of claim 15 further comprising:

a biasing spring means mounted to said one of said opposite end portions of said housing and being coupled to said support shaft so as to permit said support shaft to move and yieldably retract away from said marker buoy to permit installation and removal of the one enlarged end portion of said marker buoy onto and from said support shaft, said biasing spring means also forcing said support shaft to move and extend toward said marker buoy to retain said respective ends of said support and drive shafts engaged with said support and drive detent elements so as to maintain said marker buoy in a supported relation in said cavity of said winding apparatus.

17. The system of claim 16 wherein one of said detent elements is a cylindrical-shaped receptacle mounted in one of said enlarged opposite ends of said body and adapting said one end to be rotatably supported by said end of said support shaft of said winding apparatus by extending into said receptacle.

18. The system of claim 17 wherein the other of said detent elements is a polygonal-shaped receptacle mounted in the other of said enlarged ends of said body and adapting said other end to be non-drivingly coupled by said output drive shaft of said winding apparatus by extending into said receptacle.

19. The system of claim 15 wherein said body of said marker buoy has a dumbbell-shaped configuration.

20. The system of claim 15 wherein said body of said marker buoy has an H-shaped configuration.

* * * * *